US007696695B2

(12) United States Patent
Rahmane et al.

(10) Patent No.: US 7,696,695 B2
(45) Date of Patent: Apr. 13, 2010

(54) MERCURY-FREE METAL HALIDE DISCHARGE LAMP

(75) Inventors: Mohamed Rahmane, Clifton Park, NY (US); Agoston Boroczki, Budapest (HU); James Anthony Brewer, Scotia, NY (US); Sergiy Zalyubovskiy, Niskayuna, NY (US); Gabor Farkas, Budapest (HU); Steven Charles Aceto, Wynantskill, NY (US)

(73) Assignee: General Electric Company, Niskayuna, NY (US)

( * ) Notice: Subject to any disclaimer, the term of this patent is extended or adjusted under 35 U.S.C. 154(b) by 232 days.

(21) Appl. No.: 11/865,169

(22) Filed: Oct. 1, 2007

(65) Prior Publication Data

US 2008/0018254 A1 Jan. 24, 2008

Related U.S. Application Data

(63) Continuation-in-part of application No. 11/289,976, filed on Nov. 30, 2005.

(51) Int. Cl.
*H01J 17/20* (2006.01)

(52) U.S. Cl. ..... 313/638; 313/637

(58) Field of Classification Search ..... 313/637–641
See application file for complete search history.

(56) References Cited

U.S. PATENT DOCUMENTS 4,992,700 A 2/1991 Lake
6,069,456 A 5/2000 Fromm et al.
6,353,289 B1 3/2002 Ishigami et al.
6,469,446 B1 10/2002 Stockwald
6,483,241 B1 11/2002 Stockwald
6,528,946 B2 3/2003 Ishigami et al.
6,815,894 B2 11/2004 Takagaki et al.
6,853,140 B2 2/2005 Lapatovich et al.
6,873,109 B2 3/2005 Ishigami et al.
2003/0209986 A1 11/2003 Ishigami et al.
2007/0222389 A1* 9/2007 Hilbig ..... 313/638

FOREIGN PATENT DOCUMENTS

EP 1 351 276 10/2003
WO WO 2004/023517 3/2004

* cited by examiner

*Primary Examiner*—Vip Patel
(74) *Attorney, Agent, or Firm*—Mary Louise Gioeni

(57) ABSTRACT

A metal halide discharge lamp comprises a lamp body and a chamber formed within the body. A pair of electrodes extends into the chamber and have electrode tips spaced apart from one another. A discharge medium composition is sealed within the chamber that generates a plasma, which generates visible light. The composition comprises a rare gas, a first metal halide that produces a luminous flux and zinc iodide that generates a desired lamp operating voltage. The composition may also comprise zinc, sealed in the chamber, in elemental form that is not derived from the first metal halide or the zinc iodide. The zinc iodide halide serves as a substitute for mercury for purposes of generating desired lamp operating voltage; and, the excess pure zinc attracts or reacts with iodine atoms thereby making available electrons and the first metal halide for generation of a luminous flux.

23 Claims, 7 Drawing Sheets

FIG. 5 Dy species in CMH lamp with Hg
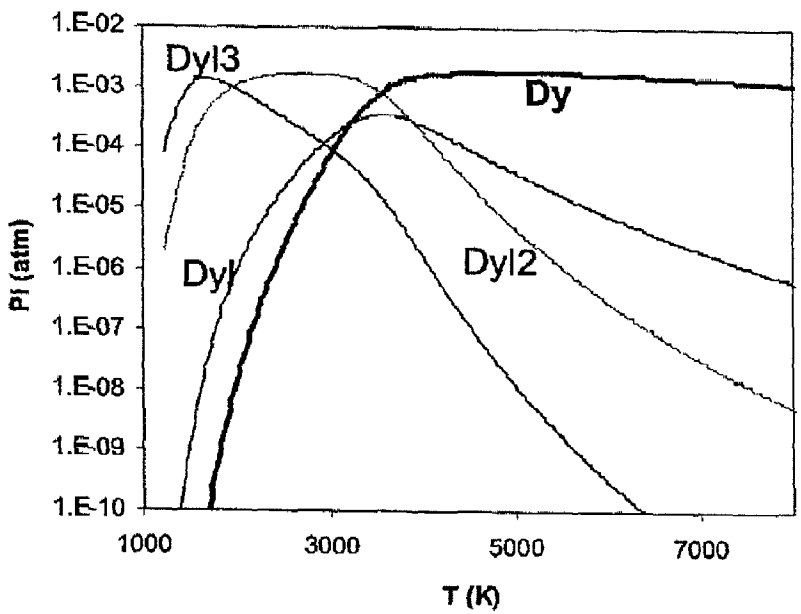
FIG. 6: Dy species in CMH lamps with ZnI2
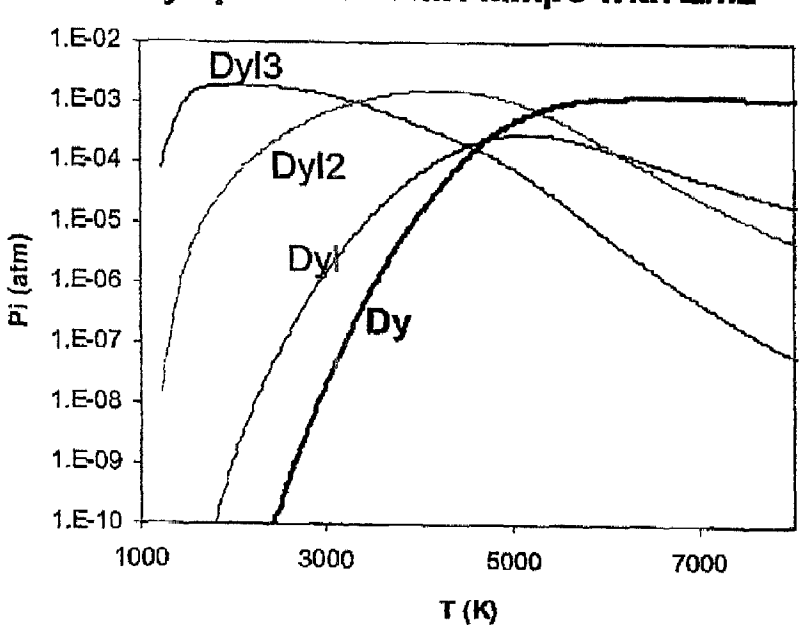

Square Waveform Current

Sine Waveform Current

MERCURY-FREE METAL HALIDE DISCHARGE LAMP

CROSS-REFERENCE TO RELATED APPLICATIONS

This application claims priority and is a Continuation-In-Part of U.S. application Ser. No. 11/289,976 filed Nov. 30, 2005, which is hereby fully incorporated by reference.

BACKGROUND OF THE INVENTION

An embodiment of the invention pertains to High Intensity Discharge (HID) lamps. More specifically, an embodiment of the invention pertains to quartz or ceramic metal halide discharge lamps.

A typical metal halide discharge lamp 10 is illustrated in FIG. 1, and includes a body 11 and a first leg 12 and a second leg 13 integrally attached to the body 11. Each leg 12 and 13 extends from an opposing side of the body 11. The legs 12 and 13 and body 11 are usually fabricated from a quartz-material or an alumina based ceramic material (e.g., polycrystalline alumina, sapphire, or yttrium aluminum garnet). A first electrode 15 and second electrode 16 extend through the first leg 12 and second leg 13 respectively and terminate in a chamber 14 formed in the body 11 of the lamp 10. The tips 15A and 16A of the electrodes are spaced apart a determined distance within the chamber 14, ranging from about 1 mm to about 20 mm forming an arc region between the electrode tips 15A and 16A. The volume of the chamber 14 is typically within the range of about 0.01 cc to about 3 cc. The chamber 14 is sealed under pressure at the ends of the legs 12 and 13 distal the chamber 14.

Before the chamber 14 is sealed, a composition including an inert gas, a metal halide dose and mercury is injected and sealed, under controlled atmosphere, in the chamber of the discharge lamp. The metal halide dose is typically a combination of metal halides such as sodium iodide and scandium iodide or sodium iodides, thallium iodide, dysprosium iodide, holmium iodide and thulium iodide. The metal halides serve as light emitting elements. While mercury contributes slightly to the emitted spectrum of a discharge lamp in the blue range, it mainly serves to increase the electrical resistance in the arc region in order to raise the voltage to a desired value. Raising the voltage to a desired value has two effects: 1) the lamp operating current can be maintained at a low value to minimize electrode erosion for better lumen maintenance and lamp life; and, 2) minimizing end-losses for better lamp efficiency. A desired operating voltage for a high intensity discharge lamp is typically from 70V to 150V so the current can be maintained from about 0.2 amps to about 3.5 amps depending on the type of lamp and a desired power.

When power is supplied to the electrodes, an electric arc strikes between the electrode tips 15A and 16A, creating a plasma discharge within the chamber 14. Initially an arc discharge is created by the rare gas (typically argon or xenon) reaching a temperature of about 7000K. The arc discharge heats the chamber 14 raising its temperature to about 1000° K or higher. Then the mercury and metal halide dose start evaporating. After this warm-up phase, the lamp reaches a steady state of operation, where the plasma discharge becomes a mixture of rare gas atoms (argon or xenon), Hg atoms and ions, metal atoms and molecules coming from the metal halide dose as well as their ions and the electrons. The temperature of the plasma discharge may range typically from about 1000° K to about 6000° K.

The lamp voltage depends strongly on the electrical conductivity of the gas mixture forming the arc. In typical HID lamps, mercury serves as a buffer gas by maintaining a certain desired lamp operating voltage. Mercury may achieve the desired voltage because of its relatively low electrical conductivity, which is the function of several parameters including atom density (or vapor pressure), electron density (or ionization energy) and electron-atom momentum transfer cross-section for the so-called buffer gas.

Mercury, as a buffer gas, has a high enough electron-atom momentum transfer cross-section and high enough vapor pressure to provide a sufficient electrical resistance at the arc region and therefore a desired lamp voltage. The collision between electrons and the metal halide compounds causes excitation of the metal atoms, which release photon energy in the form of light within the visible spectrum.

Despite the effectiveness of mercury, there are disadvantages to using this metal. Most notably, mercury is very toxic and raises health and environmental concerns. Laws and regulations have been adopted and/or proposed throughout the world limiting or, in some cases eliminating the use of mercury in all products. Accordingly, efforts are being made to replace mercury with other elements or compounds that have properties similar to mercury for purposes of generating light in a high intensity discharge lamp.

Zinc iodide has been disclosed as a substitute for mercury in the presence of metal halide additives sodium iodide (NaI) and scandium iodide (ScI3) in a quartz lamp. However, scandium is aggressive toward and reactive with alumina-based ceramics, which is the envelope material to be used in the next generation automotive headlamps.

Rare earth metal halides, such as dysprosium iodide and neodymium iodide have been disclosed as a substitute for scandium iodide (ScI3) in combination with a second metal halide that is substituted for mercury in a quartz lamp. The second metal halides include aluminum iodide, iron iodide, zinc iodide, antimony iodide, manganese iodide, chromium iodide, gallium iodide, beryllium iodide and titanium iodide.

With respect to the subject inventions various combinations of metal halides, including but not limited to zinc iodide, as a substitute for mercury, in combination with one or more rare earth metal halides, sodium iodide and thallium iodide as light emitting additives, were combined and tested in a ceramic metal halide lamp. The performance of these compounds were compared to metal halide ceramic lamps having a composition of mercury combined with the same combinations of the rare earth metal halides, sodium iodide and thallium iodide as the light emitting elements. Theoretical calculations supported by experimental tests have shown that mercury substitute metal halides disassociate into metal atoms and free iodine atoms within the arc region causing a high pressure of free iodine atoms. Iodine is known to be very electronegative. That is free electrons within the arc region attach relatively easily to the iodine atoms creating negative ions of iodine. This effect causes a significant reduction in the electrons density within the arc region. Furthermore, the iodine reacts with the rare earth metal forming stable compounds, i.e. dysprosium iodide, which causes the reduction in the density of rare earth metal atoms (light emitting species). The reduction of both electron density and light emitting species atoms (rare earth) caused by the high-pressure of free iodine affect directly in a negative way the lamp performance by reducing the amount of radiated power in the visible range (lamp lumens)

The pressure of the iodine and iodine negative ions in $ZnI_2$ dosed lamp is almost one order of magnitude greater than in the mercury-dosed lamps. This means that the electron density in the arc region as well as the light emitting atom densities are significantly lower in a $ZnI_2$ dosed lamp than in mercury lamp for instance. The net effect is reduced lumens because the electrons and the light emitting atoms are responsible for the creation of the excited states of light emitting metal atoms.

BRIEF DESCRIPTION OF THE INVENTION

An embodiment of the invention is for a mercury-free metal halide discharge lamp, and/or a composition for the same. The discharge lamp comprises a discharge medium composition having a first metal halide that produces a luminous discharge and a second metal halide that generates a lamp voltage as a substitute for mercury. In an embodiment the composition also contains a metal in pure form that is not derived from either the first metal halide or the second metal halide.

During operation of a discharge lamp the first metal halide and second metal halides dissociate producing halogen atoms and metal atoms. The metal atoms of the first halide provide the desired light output of the lamp and the metal atoms of the second halide provide the desired lamp voltage. A portion of the halogen atoms of the second halide attach to the electrons to form negative ions and some react with the metal of the first halide. The phenomenon results in a reduced amount of lumens because fewer electrons and the first metal halide atoms are available for collisions resulting in a lower lumens output. The excess metal in a pure form attracts, or reacts with the halogen, making available electrons and the first metal halide in a form that produces a luminous flux during operation of the lamp. In other words, the excess metal in a pure form acts as "getter" for the excess halogen free atoms.

In an embodiment, the second metal halide provided as a voltage riser in place of mercury zinc iodide and the metal in elemental form is zinc.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings.

FIG. 5 is a graph plotting the partial pressures of dysprosium species in a metal halide test lamp.

FIG. 6 is a graph plotting the partial pressures of dysprosium species in an Hg-CMH lamp.

DETAILED DESCRIPTION OF THE INVENTION

An embodiment of the invention for a mercury-free high intensity metal halide discharge lamp contains a discharge medium that comprises a rare gas (e.g., Ar or Xe), and a first metal halide as a light emitting element or additive that emits light within a desired range of the light spectrum and with a desired amounts of lumens. The medium also comprises a second metal halide that replaces mercury to maintain a desired operating voltage of the lamp. The discharge lamp structure comprises typical elements of a discharge lamp as illustrated in FIG. 1 and previously described.

In an embodiment, the invention also includes a metal that is reactive with a halogen and/or halogen ions that are generated during the operation of the discharge lamp. During the operation of the discharge lamp containing the above referenced discharge medium of rare gas, the first metal halide and second metal halide, the molecules of both metal halides dissociate within the arc region into metal atoms and halogen atoms. It has been determined that the largest portion of the free halogen atoms originates from the dissociation of the second metal halide: that is the voltage riser halide. The halogen atoms produced from the dissociation of the metal halides react with the metal of the first metal halide, forming stable molecular compounds that may not or will not release photons necessary for generating light thereby reducing the lumens output of the lamp.

Figure 1:
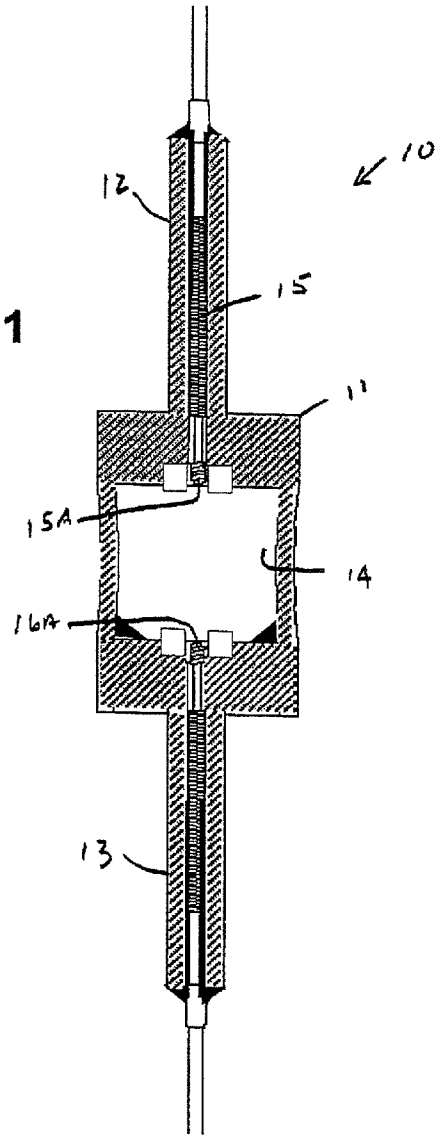
FIG. 1 is a schematic drawing of a metal halide discharge lamp.

Discharge lamps having a similar construction to the lamp illustrated in FIG. 1 and representative of ceramic metal halide lamps used for automotive headlamps were tested using various compositions of the discharge medium. The discharge lamps were seventy-watt (70 W) ceramic metal halide lamps with an arc tube fabricated from a polycrystalline alumina (PCA) ceramic. The volume of the chamber of the discharge lamps was 0.28 cubic centimeters (cc), and the distance between the electrode tips was seven millimeters (7 mm). The electrodes were comprised of a combination of conductive metals including Niobium (Nb), Molybdenum (Mo) and tungsten (W), which formed the electrode tips. However, the discharge medium of an embodiment of the invention may be used in lamps fabricated from other materials such as quartz, YAG (Yttrium aluminum garnet) or sapphire or different size lamps. For example, the discharge medium may be used in lamps used for general lighting having volumes ranging from about 0.01 cc to about 3 cc, the distance between electrode tips may range from about 1 mm to about 20 mm and the wattage may range from about twenty watts (20 W) to about four hundred watts (400 W). For optical applications such as automotive or video uses, the volume of the lamp chamber may range from about 0.01 cc to about 0.1 cc and the spacing between the electrode tips may range from about 1 mm to about 6 mm.

The lamps tested included discharge lamps using the same amounts of a first metal halide that served as the light emitting material and various combinations and amounts of a second metal halide that served as a voltage "riser" or mercury substitute. The tests monitored the performance of the lamps in terms of lamp operating voltage and lumens considering various factors such as the dose type, amount, density and composition of the second metal halide, the lamp operating current and power. These test results were compared to similar tests conducted on standard ceramic metal halide lamps (Hg-CMH lamps) that included mercury as the voltage riser. The test lamps and the Hg-CMH lamps both included identical combinations and amounts of the light emitting elements or first metal halide as well as the amount or pressure of the rare gas. More specifically, all the lamps included NaI and rare earth metal halides TlI, $DyI_3$, $HoI_3$ and $TmI_3$ as well as 200 torr of Ar. The first metal halide should refer to one or more light emitting elements or additives. In an embodiment, the total dose of the light-emitting element includes 10 mg, or about 36 mg/cc, including of 66.8 percent by weight of NaI, 9.2 percent by weight of TlI, 12 percent by weight of $DyI_3$, 6 percent by weight of $HoI_3$ and 6 percent by weight of $TmI_3$. However, one skilled in the art will appreciate that the dose ratios, amounts or compounds may vary according to type of discharge lamp used. In addition, all lamps contained the inert gas argon sealed in the chamber at 200 torr. The pressure of argon in the lamp may range from about 100 torr to about 300 torr.

Prior to conducting the tests various metal iodides were selected having properties comparable to mercury, namely a high vapor pressure (or high atoms density), high ionization energy (or low electron density) and a large electron-atoms momentum transfer cross-section. The vapor pressures of various metal iodides were computed for a 1200° K cold spot temperature for an automotive ceramic metal halide lamp. The parameters chosen for computing the vapor pressure were determined by the specific discharge lamp used in the testing; however, these parameters may differ depending on the type of discharge lamp to be tested. In addition, other halogens may be used, such as bromine and chlorine, for providing an acceptable metal halide.

Those metal halides selected as candidates for replacing mercury included metal halides having a vapor pressure of at least 1 atm and an ionization energy of at least 6 eV at a cold spot temperature of 1200° K. Those metals chosen included zinc, aluminum, indium, gallium, zirconium, hafnium, antimony, nickel, titanium, iron, magnesium, copper and beryllium. The selection parameters, such as a minimum vapor pressure or minimum ionization energy of the metal halide compound will differ according to the type of lamp tested or used.

The performance of the test lamps in terms of the operating voltage and lumens was compared to the performance of the Hg-CMH lamps to determine which of the metal halide mercury substitutes performed comparatively with mercury in terms of maintaining an acceptable voltage and lumens at an acceptable current.

Table I below provides a list of the metal iodides, including the dose amounts and test results of sample test lamps showing the performance of test lamps that operated within a range of power about 66 watts to about 71 watts, similar to that of the Hg-CMH lamps.

By way of example the Hg-CMH lamp included a dose of 4.4 mg of mercury, operated at a power of 66 watts, produced a voltage of 69 volts and maintained an efficacy of 84 lumens per watts. Test lamp 660 included a dose amount of 4.3 mg of indium iodide ($InI_3$) as the second metal halide mercury substitute. At a power of 67.15 watts, the test lamp 660 maintained a voltage of 39 watts and an efficacy of 46 lumens per watts.

Test lamp 629 included a dose amount of 3.8 mg of $ZnI_2$ and a dose amount of 3.5 mg of $AlI_3$ as the second metal halide mercury substitute. This test lamp, operating at 69 watts, produced an operating voltage of 49 volts, and an efficacy of 48 lumens per watts.

The test lamps including $MgI_2$, $SnI_4$, CuI, $SbI_3$, $FeI_2$ or $NiI_2$ did not operate at sufficiently high power to produce lumens output to serve as an acceptable substitute for mercury.

It was found that increasing the amount, or density, of the second metal halide did help in increasing the lamp operating voltage but did not necessarily result in increasing the lumens per watts of the test discharge lamps. Indeed, increasing voltage with the amount of the second metal halide degraded the lumens. With respect to Tables II test results are listed for eight test lamps each containing different amounts of $GaI_2$.

TABLE I

| Sample # | Dose Type | Dose 1 (mg) | Dose 2 (mg) | Total Dose (mg) | Voltage (V) | Current (A) | Power (W) | Luminous Flux (lms) | LPW (Lms/W) |
|---|---|---|---|---|---|---|---|---|---|
| 521 | CMH-Hg | 4.4 | — | 4.4 | 69 | 0.95 | 66 | 5488 | 84 |
| 629 | $ZnI_2/AlI_3$ | 3.8 | 3.5 | 7.3 | 49 | 1.40 | 69 | 3330 | 48 |
| 660 | InI | 4.3 | — | 4.3 | 39 | 1.72 | 67 | 3070 | 46 |
| 574 | $ZnI_2$ | 9.1 | — | 9.1 | 42 | 1.62 | 68 | 3018 | 44 |
| 700 | $ZnI_2/GaI_2$ | 5.4 | 5 | 10.4 | 96 | 0.74 | 70 | 3021 | 43 |
| 575 | $AlI_3$ | 10.1 | — | 10.1 | 47 | 1.41 | 66 | 2600 | 40 |
| 668 | $InI_3$ | 2.4 | — | 2.4 | 47 | 1.42 | 67 | 2607 | 39 |
| 565 | $GaI_2$ | 11.2 | — | 11.2 | 79 | 0.88 | 69 | 1321 | 19 |
| 636 | $MgI_2$ | 13.5 | — | 13.5 | 28 | 1.51 | 43 | 801 | 19 |
| 532 | $SnI_4$ | 15.3 | — | 15.3 | 24 | 1.41 | 34 | 406 | 12 |
| 539 | CuI | 16.3 | — | 16.3 | 19 | 1.63 | 31 | 156 | 5 |
| 611 | $SbI_3$ | 6.8 | — | 6.8 | 51.3 | 0.78 | 40 | 171 | 4 |
| 538 | $FeI_2$ | 18 | — | 18.0 | 28 | 1.24 | 35 | 131 | 4 |
| 643 | $NiI_2$ | 7.3 | — | 7.3 | 27 | 1.48 | 38 | 70 | 2 |

TABLE II

| Sample # | Dose Type | Dose (mg) | Dose Density (mg/cc) | Volts (V) | Current (A) | Power (W) | Luminous Flux (lms) | LPW (Lms/W) |
|---|---|---|---|---|---|---|---|---|
| 583 | $GaI_2$ | 1.9 | 6.8 | 29 | 2.24 | 66 | 2418 | 37 |
| 581 | $GaI_2$ | 4.0 | 14.4 | 38 | 1.72 | 65 | 2398 | 37 |
| 582 | $GaI_2$ | 4.5 | 16.2 | 45 | 1.60 | 72 | 2498 | 35 |
| 567 | $GaI_2$ | 6.2 | 22.3 | 70 | 1.16 | 70 | 2087 | 30 |
| 568 | $GaI_2$ | 6.8 | 24.5 | 58 | 1.16 | 68 | 2118 | 31 |
| 593 | $GaI_2$ | 8.1 | 29.2 | 81 | 0.81 | 65 | 1744 | 27 |
| 565 | $GaI_2$ | 11.2 | 40.3 | 79 | 0.88 | 69 | 1321 | 19 |
| 565 | $GaI_2$ | 11.2 | 40.3 | 77 | 0.83 | 64 | 1196 | 19 |

As shown in Table II, test lamp 581 produced the highest lumens output of 37 lumens per watts, having a 4.0 mg dose of $GaI_2$ or a density of 16.2 mg/cc as the second metal halide mercury substitute. The test lamp 582 contained a 4.5 mg dose of $GaI_2$ and the lumens output dropped slightly to 35 lumens per watts. The lumens output dropped more significantly with test lamp 567 which contained a 6.2 mg dose or 22.3 mg/cc of $GaI_2$ and produced 30 lumens per watts. Based on the tests conducted it was determined that dose amounts of the second metal halide mercury substitute may range from about 1 mg/cc up to about 100 mg/cc may produce sufficient voltage and lumens for operation of a metal halide discharge lamp. A preferred range of the dose amount is from about 5 mg/cc to about 20 mg/cc with a preferable dose amount being about 18 mg/cc.

Although the test lamps did not produce lumens output as high as the Hg-CMH lamps, increasing the cold spot temperature of the lamp chamber may increase the lumens. This may be accomplished by changing the geometry of the chamber namely reducing the length, diameter and/or volume of the chamber and or by changing the parameters related to the dose of light emitting metal halides (first halide). By increasing the cold spot temperature, the vapor pressure within the chamber of both the first metal halide and second metal halide can be increased leading to increased lumens output. Also, selecting an adequate dose type and composition of the light emitting metal halide elements can enhance the lumens.

Figure 2:
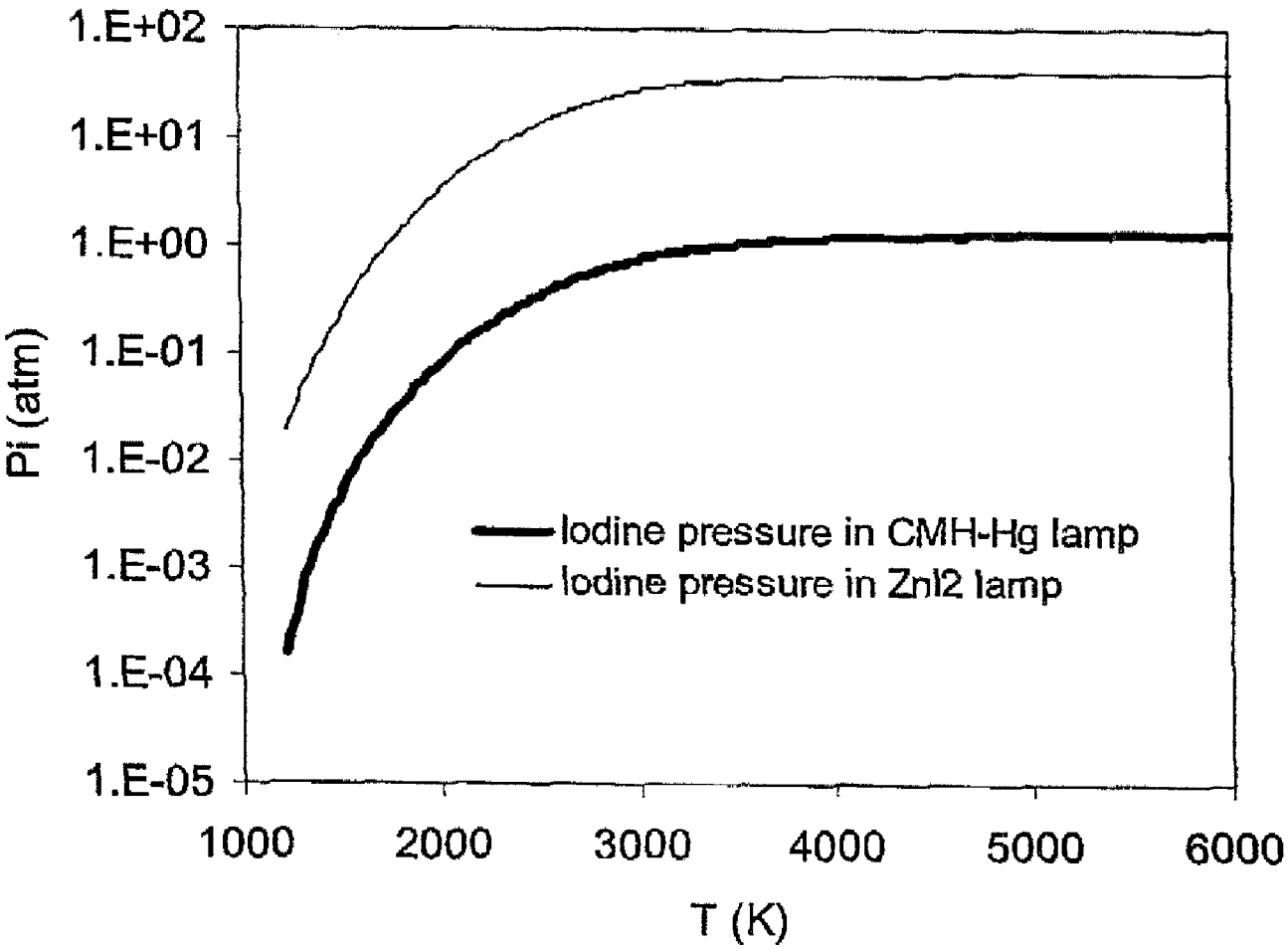
FIG. 2 is a graph plotting the partial pressure of iodine in a metal halide test lamp and an Hg-CMH lamp.

In addition to the above-described tests, the partial pressures for iodine, iodine negative ions, electrons, and dysprosium species were calculated for a metal halide ($ZnI_2$) test lamp and a standard Hg-CMH lamp for temperatures ranging from about 1000° K to about 6000° K. This is the range of operating temperatures of the arc region depending on the location within the arc region from which the temperature is measured. With respect to FIG. 2, the pressure of iodine within the lamp chamber is plotted versus the temperature within the lamp chamber. As noted above the metal halide mercury substitute in the lamp was $ZnI_2$. The iodine pressure is substantially and consistently higher in the $ZnI_2$ test lamp in comparison to the mercury Hg-CMH lamp.

Figure 3:
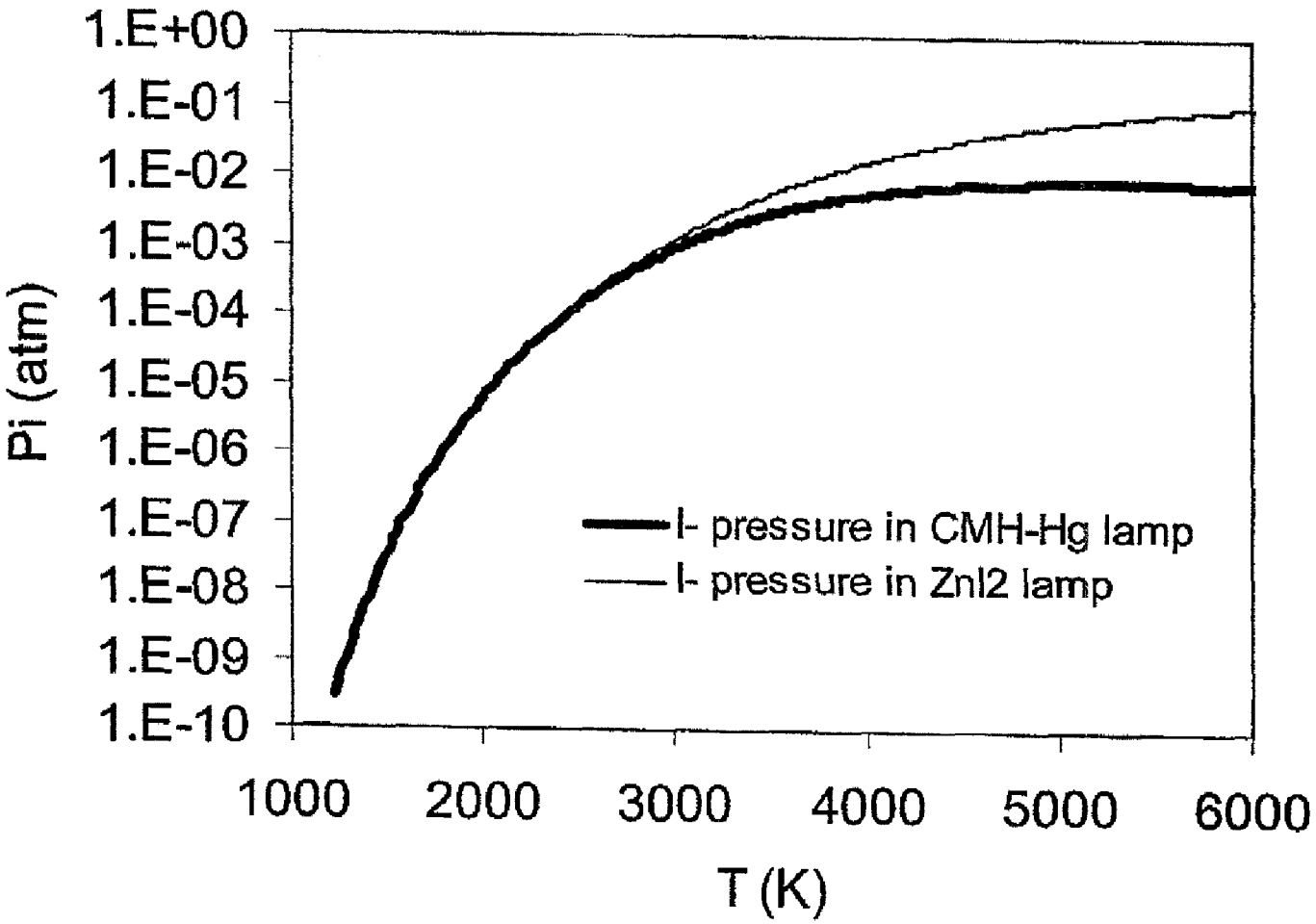
FIG. 3 is a graph plotting the partial pressure of iodine negative ion in a metal halide test lamp and an Hg-CMH lamp.

Similarly, the partial pressure of the iodine negative ions in the chamber of the $ZnI_2$ test lamp was higher than in the Hg-CMH lamp. With respect to FIG. 3, the partial pressure of iodine negative ions within the lamp chamber is plotted versus the temperature within lamp chamber. The iodine negative ion partial pressure is consistently higher in the $ZnI_2$ test lamp in comparison to the mercury Hg-CMH lamp in the temperature of about 3000° K to about 6000° K.

Figure 4:
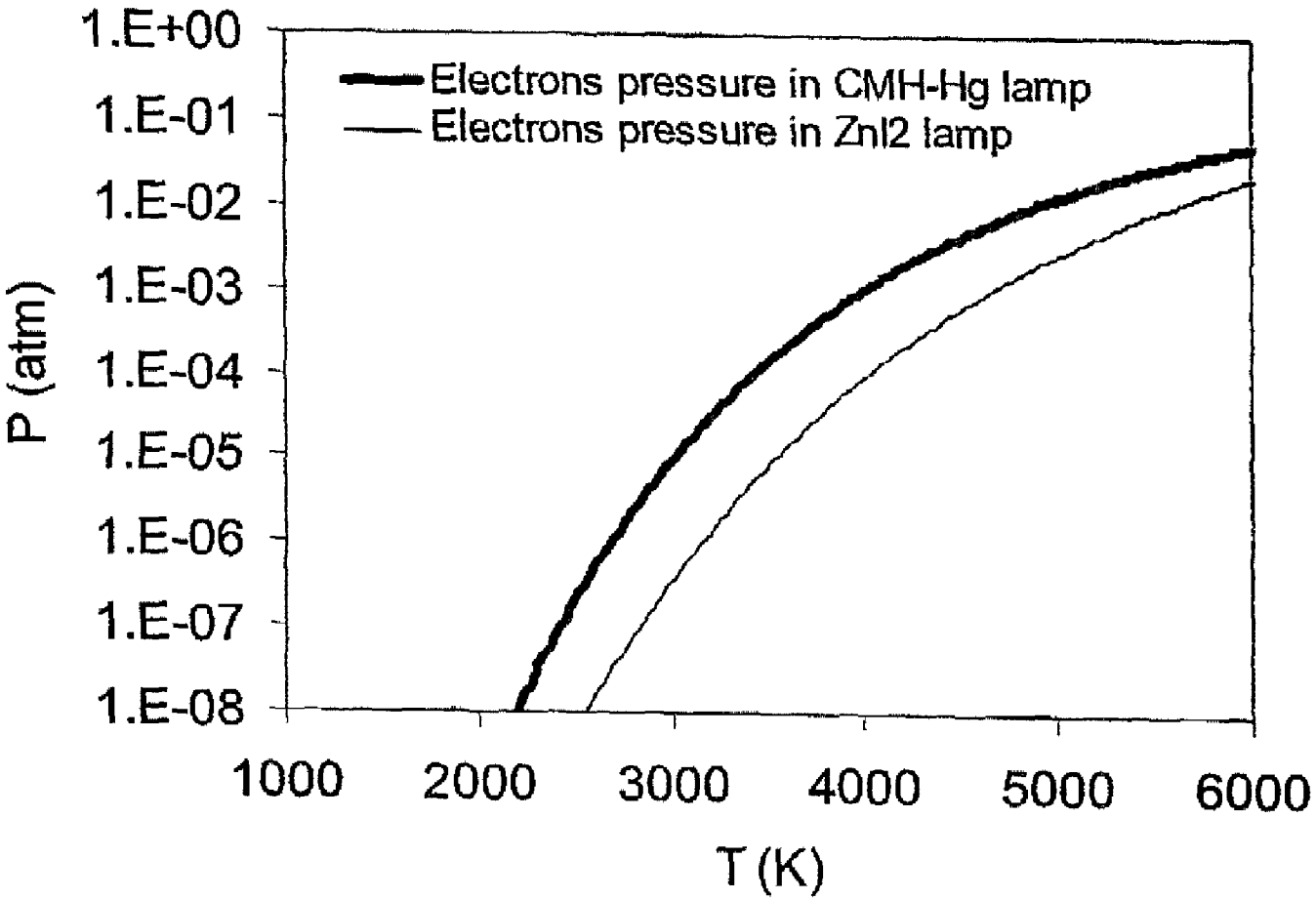
FIG. 4 is a graph plotting the partial pressure of electron in a metal halide test lamp and an Hg-CMH lamp.

The increased iodine partial pressure in the test lamp indicates that dissociation of the $ZnI_2$ takes place producing iodine and thereafter iodine negative ions. Given the high electronegative nature of iodine, the electron partial pressure was calculated at temperature ranges from about 3000° K to about 6000° K. The FIG. 4 is a graph plotting the electron partial pressure versus the temperature within the lamp chamber. The electron pressure in the $ZnI_2$ test lamp is consistently lower than the electron pressure of the Hg-CMH test lamp. It has been concluded that the iodine attracts electrons in the arc region, thereby reducing the number of electrons available in the arc region for the excitation of the metal of the first metal halide (the light emitting elements). This resulted in reduced lumens output of the metal halide mercury substitute test lamps.

In addition, the partial pressures of the dysprosium species were calculated within the temperature. At such high temperatures the dysprosium iodide dissociates like the zinc iodide. The iodine will react with dysprosium atoms forming more stable DyI, $DyI_2$ and $DyI_3$ molecules, which do not emit light or do not emit light as well as the dysprosium atoms. With respect to FIGS. 5 and 6, the partial pressures of the dysprosium species were calculated within a temperature range from about 1000° K to about 6000° K for the metal halide test lamp and the Hg-CMH lamp. As shown in FIGS. 5 and 6, for example at 4000° K, the partial pressure of dysprosium in the $ZnI_2$ test lamp is substantially lower than in the Hg-CMH test lamp. In contrast, at that same temperature, the partial pressure of $DyI_3$, $DyI_2$ and DyI are substantially higher in the $ZnI_2$ test lamp than in the Hg-CMH lamp.

The effect of high-pressure of free iodine on the reduction of the partial pressure of the light emitting elements in the $ZnI_2$ lamps has been illustrated here for the dysprosium but the same effect was found for the other light emitting elements, namely sodium, thallium, Holmium and thulium In order to overcome the effect of iodine and iodine negative ions in reducing the pressures and/or amounts of electrons and light emitting elements, a metal in its pure form (not metal halide) was added to the discharge medium composition of the metal halide test lamps. For example, zinc was included with a zinc iodide dose. Other metals added included aluminum, gallium and indium, or a combination two, three or four of these metals. Table III below lists sample test lamps that included a dose of zinc iodide as a mercury substitute and a dose of zinc. The same light emitting elements (first metal halide) at the same dose amounts were used in these test lamps as in all other test lamps. In addition, argon was also injected into the chamber at the same pressure.

TABLE III

| Sample # | Dose Type | $ZnI_2$ Dose (mg) | $ZnI_2$ Dose Density (mg/cc) | Volts (V) | Current (A) | Power (W) | Luminous Flux (lms) | LPW (Lms/W) |
|---|---|---|---|---|---|---|---|---|
| 676 | $Zn/ZnI_2$ | 5.8 | 20.9 | 67 | 0.83 | 71 | 3672 | 52 |
| 677 | $Zn/ZnI_2$ | 6.1 | 22.0 | 75 | 0.87 | 71 | 3954 | 55 |
| 684 | $Zn/ZnI_2$ | 6.9 | 24.8 | 73 | 0.96 | 70 | 3846 | 55 |
| 693 | $Zn/ZnI_2$ | 7.1 | 25.6 | 78 | 0.90 | 70 | 3857 | 55 |
| 692 | $Zn/ZnI_2$ | 9.2 | 33.1 | 80 | 0.88 | 70 | 3456 | 49 |
| 679 | $Zn/ZnI_2$ | 9.5 | 34.2 | 83 | 0.86 | 71 | 3609 | 51 |
| 678 | $Zn/ZnI_2$ | 10.3 | 37.1 | 84 | 0.82 | 70 | 3271 | 47 |
| 690 | $Zn/ZnI_2$ | 10.9 | 39.2 | 86 | 0.82 | 70 | 3124 | 45 |
| 667 | $Zn/ZnI_2$ | 14.5 | 52.2 | 89 | 0.78 | 69 | 2845 | 41 |

When combined with zinc iodide, the dose amount of zinc ranged from about 4 mg up to about 14.5 mg; however different amounts of zinc, other metals and combinations can be used in combination with one or metal halide mercury substitutes.

The test results of those test lamps that operated at voltages similar to that of Hg-CMH lamps, or in a range of about 65 watts to about 71 watts, were compared to the test results of the other test lamps having a metal halide mercury substitute and the Hg-CMH lamps. Table IV below lists sample test lamps having a metal dose in combination with doses of one or more metal halide mercury substitutes. The zinc was added as an "iodine collector." That is zinc reacted with available iodine or iodine ions forming zinc mono-iodide and other zinc iodide species; thereby, preventing a significant portion of iodine atoms from collecting or reacting with free electrons and metal atoms of the first metal halide available to produce a light discharge.

TABLE IV

| Sample # | Dose Type | Dose 1 (mg) | Dose 2 (mg) | Dose 3 (mg) | Total Dose (mg) | Voltage (V) | Current (A) | Power (W) | Luminous Flux (lms) | LPW (Lms/W) |
|---|---|---|---|---|---|---|---|---|---|---|
| 521 | CMH-Hg | 4.4 | — | — | 4.4 | 69 | 0.95 | 66 | 5488 | 84 |
| 677 | $Zn/ZnI_2$ | 13.5 | 6.1 | — | 19.6 | 75 | 0.87 | 71 | 3954 | 55 |
| 695 | $Zn/ZnI_2/GaI_2$ | 19.6 | 4.2 | 3.8 | 27.6 | 77 | 0.91 | 70 | 3846 | 55 |
| 705 | $Zn/ZnI_2/AlI_3$ | 15 | 4.1 | 4.3 | 23.4 | 83 | 0.84 | 70 | 3437 | 49 |
| 629 | $ZnI_2/AlI_3$ | 3.8 | 3.5 | — | 7.3 | 49 | 1.40 | 69 | 3330 | 48 |
| 660 | InI | 4.3 | — | — | 4.3 | 39 | 1.72 | 67 | 3070 | 46 |
| 574 | $ZnI_2$ | 9.1 | — | — | 9.1 | 42 | 1.62 | 68 | 3018 | 44 |
| 700 | $ZnI_2/GaI_2$ | 5.4 | 5 | — | 10.4 | 96 | 0.74 | 70 | 3021 | 43 |
| 575 | $AlI_3$ | 10.1 | — | — | 10.1 | 47 | 1.41 | 66 | 2600 | 40 |
| 668 | $InI_3$ | 2.4 | — | — | 2.4 | 47 | 1.42 | 67 | 2607 | 39 |
| 565 | $GaI_2$ | 11.2 | — | — | 11.2 | 79 | 0.88 | 69 | 1321 | 19 |
| 636 | $MgI_2$ | 13.5 | — | — | 13.5 | 28 | 1.51 | 43 | 801 | 19 |
| 532 | $SnI_4$ | 15.3 | — | — | 15.3 | 24 | 1.41 | 34 | 406 | 12 |
| 539 | CuI | 16.3 | — | — | 16.3 | 19 | 1.63 | 31 | 156 | 5 |
| 611 | $SbI_3$ | 6.8 | — | — | 6.8 | 51 | 0.78 | 40 | 171 | 4 |
| 538 | $FeI_2$ | 18 | — | — | 18 | 28 | 1.24 | 35 | 131 | 4 |
| 643 | $NiI_2$ | 7.3 | — | — | 7.3 | 27 | 1.48 | 38 | 70 | 2 |

The test lamps having the excess metal consistently produced higher voltage and lumens values at acceptable currents. The highest lumens output for those test lamps having a metal halide mercury substitute dose without a dose of a metal was from test lamp 629. This test lamp included a combination of $ZnI_2$ and $AlI_3$ in dose amounts of 3.8 mg and 3.5 mg respectively. The lumens output was 48 lumens per watts; however, the voltage was relatively low at 49 volts. The highest voltage output for such test lamps was from test lamp 565. This lamp included an 11.2 mg dose of $GaI_2$ as the mercury substitute and produced a voltage of 79 volts; however the lumens was relatively low at 19 lumens per watts.

In comparison, test lamp 677 included a 13.5 mg dose of Zn and a 6.1 mg dose of $ZnI_2$. This lamp produced a voltage of 75 volts and lumens of 55 lumens per watts. Indeed, each of the test lamps 695 and 705 that included a dose amount of zinc in combination with a dose amount of one or more of the second metal halides produced higher voltages and lumens than test lamps not having the excess metal combined with the second metal halide. The dose amount of excess metal in the chamber may range from about 1 mg to about 15 mg., or may have a density ranging from about 3.6 mg/cc to about 72 mg/cc. Preferably, the dose amount of the excess metal may range from about 2 mg to about 5 mg, or the density may range from about 7.2 mg/cc to about 18 mg/cc.

Figure 7:
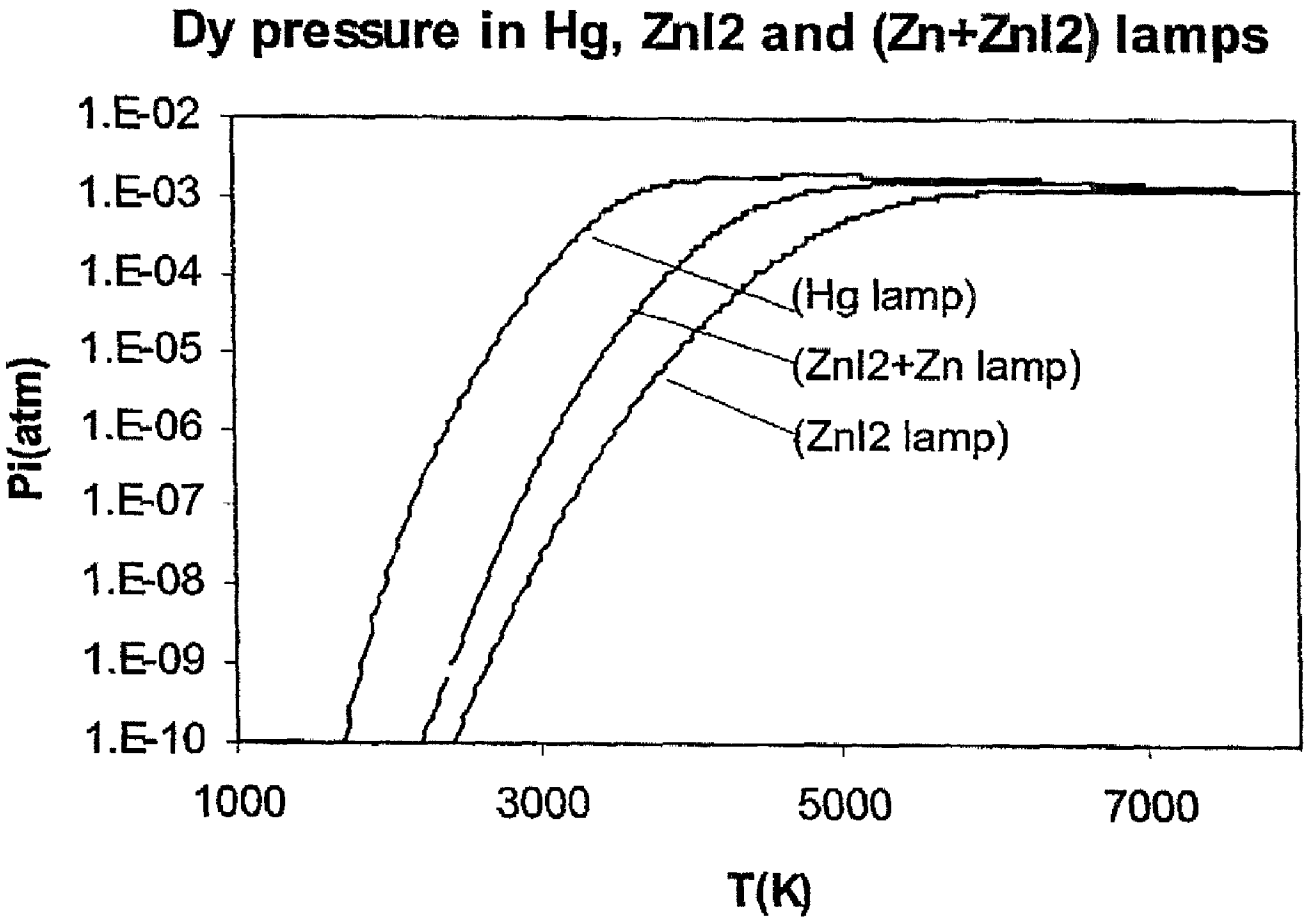
FIG. 7 is a graph plotting the partial pressures of dysprosium atoms in a $ZnI_2$ test lamp, a $ZnI_2$ test lamp dosed with excess Zn and an Hg-CMH lamp.

The partial pressure for dysprosium was calculated within temperature ranges of 1000° K to about 6000° K. With respect to FIG. 7, a graph plotting the pressure of dysprosium versus the temperature within the chamber is shown. This graph illustrates that within the selected temperature range the dysprosium partial pressure of the test lamp having the excess zinc was consistently higher than the test lamp without the metal. More dysprosium was available as a light emitting element, which resulted in higher lumens values. Accordingly, it was found that zinc, aluminum, gallium or indium metal halides may serve as acceptable substitutes for mercury in a metal halide discharge lamp. Adding a metal that is reactive with a halogen or halogen ions that is produced during the operation of the lamp, in order to make available the light emitting element and electrons for a luminous discharge, enhances the efficacy of the lamp.

Most mercury ceramic metal halide used in general lighting typically operate with a ballast that produces a current sine waveform. In as much as the test lamps were replicas of ceramic metal halide lamps, the ballast used produced a current sine waveform. It was found that the test lamps could not operate in a stable manner or not operate at all employing a current sine waveform. Most of the lamps extinguished after operating about thirty seconds to about a minute.

The re-ignition voltage was too high with a current sine waveform. This was due to the high pressure of halogen and to its electronegative effect. With any AC current waveform, the applied current goes through zero during the polarity change and thereby the plasma temperature and electron density is significantly reduced. Just after the polarity change, the plasma "re-ignites" again and the electron density is increased again. This phenomenon usually manifests itself on the waveform of the lamp operating voltage with a spike called "re-striking voltage". In the presence of high-pressure of iodine, as it is the case of Hg-free lamps where Hg is substituted by a metal halide dose, the electrons density is further reduced during the polarity change due to the electronegative effect of iodine. This makes it difficult for the plasma to "re-ignite", which leads to an extremely high "re-striking voltage" spike. The net effect is that the Hg-free lamps operated with a sine waveform are either unstable or they extinguishes about thirty seconds to sixty seconds after they start.

Figure 8B:
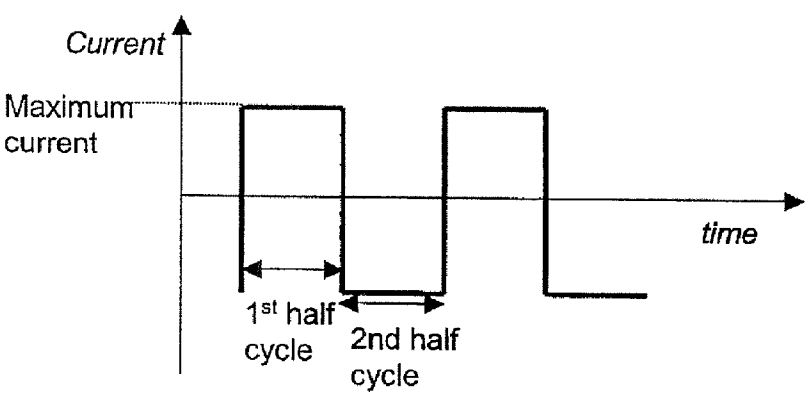
FIG. 8B is a graph of a square waveform current.
Figure 8A:
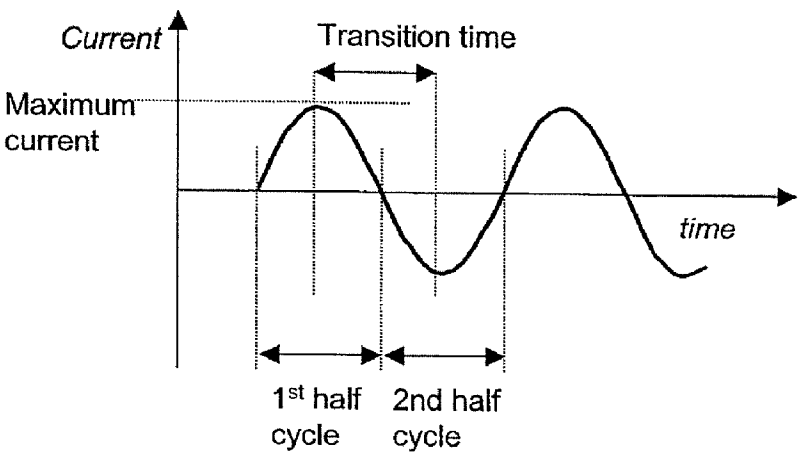
FIG. 8A is a graph of a sine waveform current.

It has been found in the work related to an embodiment invention that this problem can be solved by changing the current waveform from a sine shape to a square shape. With respect to FIGS. 8A and 8B, the transition time between the absolute values of maximum current in the first half cycle and second half cycle is significantly larger for a current waveform of sine shape than a current waveform of square shape.

For example, for an operating frequency of 60 Hz, this transition time is about 8.3 milliseconds for the waveform of sine shape and about 50 micro-seconds for the waveform of square shape. Therefore, with the square waveform, the transition time can be significantly reduced. By doing so, the period of time, during which the plasma temperature is reduced and where the electrons have a chance to recombine, is significantly reduced. In summary, the "re-striking voltage" with a square waveform for the Hg-free lamp was comparable to the Hg lamp and all the Hg-free lamp tested in the work related to this invention operated with square waveform operated in a stable manner.

As described above, it has been found that certain metal halides having electrical properties similar to that of mercury may serve as acceptable voltage riser substitutes for mercury. In particular, $ZnI_2$ was found to increase voltage in a CMH lamp to acceptable operating levels; however, because each atom of $ZnI_2$ in the vapor has two atoms of iodine within the plasma, too large amounts of $ZnI_2$ have an adverse effect on the lamp efficacy (LPW or lumens per watt). Iodine is very electronegative (affinity for electrons), and grabs free electrons in the plasma, forming iodine ions and reducing the density of electrons which lead to a reduction in the luminous flux. Free iodine in a sufficient amount may react with the light emitting elements of the first metal halide, especially the rare earth elements (e.g. Ce) reducing the density of their free atoms and therefore the light emission. As further described above, introducing a small amount of Zn with the $ZnI_2$ reduces the negative effect of excess free iodine while giving a large enough voltage. This combination of Zn and $ZnI_2$ enhances the lamp efficacy.

It has also been found that the amount of pure Zn (metallic) that can be added is also limited. Pure zinc has an adverse effect on both lamp efficacy and lamp life. This is because Zn reacts with the rare earths of the metal halide liquid pool leading to lower valence rare earth iodides. For instance, cerium iodide $CeI_3$ of the first metal halide dose will be reduced to $CeI_2$, CeI and Ce. This reaction mechanism has two adverse effects: (1) the lower valence rare earth iodides and the rare earth element created (e.g. $CeI_2$, CeI and Ce) are more reactive with a ceramic arc tube than $CeI_3$, and (2) the lower valence rare earth metal (Ce) created also has lower partial pressure than $CeI_3$, which means there is lower amounts of Ce in the gas phase, resulting lower lumens efficacy. Accordingly, the below-described testing of CMH lamps identifies dose amounts of Zn and $ZnI_2$ as a substitute for mercury with comparable voltage and lumens output.

In reference to Table V below, seven different groups or cells of discharge lamps were tested including various dose amounts and combinations of one or more of a first metal halide (the radiator or light emitting compounds), the second metal halide ($ZnI_2$—the voltage riser) and zinc (Zn). The tests monitored the performance of the lamps in terms of lamp operating voltage and lumens considering such factors as the amount, density and composition of the first metal halide, the second metal halide and Zn. The discharge lamps tested were thirty-five watt (35 W) ceramic metal halide lamps having an arc tube and arc legs composed of yttrium alumina garnet (YAG). Electrodes fixed in the arc tubes included a pair of tungsten tips that were about 4 mm long and spaced apart forming an arc gap about 4 mm wide within a discharge chamber having a volume of about 0.02 cc. The electrodes also included leg portions composed of molybdenum and niobium. In addition, xenon (Xe) was used as a buffer gas in the arc chamber under pressure at 12 bar at room temperature.

TABLE V

| Cell # | $ZnI_2$ Dose (mg) | $ZnI_2$ Dose Density (mg/cc) | Zn Dose (mg) | Metal Halide Radiator Dose (mg) | Volts (V) | Current (A) | Power (W) | Luminous Flux (lms) | LPW (Lms/W) |
|---|---|---|---|---|---|---|---|---|---|
| 1 | 0.4 | 20.0 | 0 | 2.0 | 33 | 1.06 | 34 | 2561 | 74 |
| 2 | 0.2 | 10.0 | 0.1 | 2.0 | 35 | 0.97 | 34 | 2628 | 77 |
| 3 | 0.4 | 20.0 | 0.1 | 2.0 | 40 | 0.90 | 35 | 2689 | 77 |
| 4 | 0.6 | 30.0 | 0.1 | 2.0 | 35 | 1.05 | 35 | 2132 | 61 |
| 5 | 0.4 | 20.0 | 0.2 | 2.0 | 31 | 1.08 | 34 | 1962 | 58 |
| 6 | 0.4 | 20.0 | 0.1 | 1.0 | 42 | 0.84 | 35 | 2351 | 68 |
| 7 | 0.4 | 20.0 | 0.1 | 4.0 | 32 | 1.08 | 35 | 2346 | 68 |

For each Cell 1-7, two to eight lamps were tested. As shown in Table V, the dose amount of $ZnI_2$ ranged from about 0.2 mg to about 0.6 mg, the dose amount of Zn ranged from 0.0 mg to about 0.2 mg; and, the dose amount of the first metal halide ranged from about 1.0 mg to about 4.0 mg. The composition of the first metal halide remained the same for all seven Cells, and included NaI (54% by weight), TlI (5% by weight), InI (2% by weight), CsI (4% by weight) and $CeI_3$ (35% by weight).

As shown in Table V, Cell 1, 2 and 3 test lamps having dose amounts of about 0.2 mg to about 0.4 mg of $ZnI_2$, zero to about 0.1 mg of Zn and about 2.0 mg of the first metal halide maintained a consistently higher lamp efficacy in terms of lumens per watt output. More specifically, Cell 1 lamps maintained an efficacy of about 67.2 to about 81.3 lumens per watt, with an average efficacy of 77 lumens per watt; Cell 2 lamps maintained an efficacy from about 67.6 to about 80.5 lumens per watt with an average efficacy of 77 lumens per watt; and, Cell 3 lamps maintained an efficacy ranging from about 72.7 to about 79.0 lumens per watt with an average efficacy of 77 lumens per watt.

Given the closeness in the lumen values of Cell 1, 2 and 3 test lamps, one may conclude that increasing the amount of Zn in the discharge chamber above a total of 0.3 mg or 0.4 does not necessarily result in an increase of the efficacy of the lamp. However, the Cell 3 test lamps had a voltage output that was about 15% higher than the voltage output higher than that of the Cell test lamps 1 and 2. More specifically, the Cell 3 test lamps had an average voltage output of 40V while the Cell 1 and 2 test lamps had average voltage outputs of 33 V and 35 V respectively. An increased voltage translates to an increased resistance across the arc gap, which results in higher lumens output. In addition, the average current, 0.90 A, for the Cell 3 test lamps was lower than the current for the Cell 1 and 2 test lamps. A lower current results in lower operating temperatures of the electrode tips, which is beneficial for good lumen maintenance of the lamp.

Tests showed that increasing the amount of Zn, either in the form of $ZnI_2$ or Zn above about 0.4 mg, while maintaining the same dose amounts of the first metal halide, reduced the lumens output of the lamps. More specifically, in Cell 4 test lamps the dose amount of $ZnI_2$ was raised to about 0.6 mg while the dose amounts of Zn and the first metal halide remained the same as in Cell 2 and 3 test lamps. The Cell 4 test lamps had an efficacy ranging from 54.4 to 74.9 lumens per watt with an average efficacy of 61 lumens per watt. In comparison, the dose amount of Zn in the Cell 5 test lamps was increased to about 0.2 mg while the dose amount of $ZnI_2$ and the first metal halide remained the same as in the Cell 3 test lamps. The Cell 5 test lamps maintained an efficacy ranging from about 47.2 to about 68.2 lumens per watt with an average efficacy of 58 lumens per watt.

To that end Table VI provides test results for four Cells (1-4) of test lamps wherein the dose amount of $ZnI_2$ was increased from lamp to lamp from about 0.2 mg to about 0.8 mg. Each of the test lamps included a dose amount of about 0.1 mg of Zn; and, the dose composition of the first metal halide was the same for those test lamps referred to in Table V including the dose amount of about 2.0 mg. Cell 1, 2, 3 and 4 test lamps referred to below are different test lamps than the test lamps referred to in Table V, and tested using the above-described dose amounts of $ZnI_2$ and Zn.

TABLE VI

| Cell # | $ZnI_2$ Dose (mg) | $ZnI_2$ Dose Density (mg/cc) | LPW (Lms/W) |
|---|---|---|---|
| 1 | 0.2 | 10.0 | 66 |
| 2 | 0.4 | 20.0 | 69 |
| 3 | 0.6 | 30.0 | 67 |
| 4 | 0.8 | 40.0 | 63 |

Consistent with previously described testing, as the dose amount of $ZnI_2$ increased above 0.4 mg the lamp efficacy declined. For example, in Cell 3 and 4 test lamps, the dose amount of $ZnI_2$ was increased to 0.6 mg and 0.8 mg respectively. Consequently, the average efficacy dropped from 69 (for Cell 2 test lamps) to 67 and 63 lumens per watt respectively for Cell test lamps 3 and 4.

The test results set forth in Tables V and VI are consistent with the above-described test results that included a combination of $Zn/ZnI_2$, which test results are set forth in Table III. As shown in Table III, the four test lamps 676, 677, 684 and 693, having the highest lamp efficacy included $ZnI_2$ dose densities ranging from about 20.9 mg/cc to about 25.6 mg/cc. In comparison, the dose density of the Cell 3 test lamps, which produced the highest lumens and voltage output in Table V, had a $ZnI_2$ dose density of about 20 mg/cc. The test lamps referenced in Table III had an arc chamber volume of about 0.28 cc, in comparison to test lamps used in the tests represented in Table V and Table VI, which lamps included an arc chamber volume of 0.02 cc. Accordingly, the test lamps of Table III included larger dose amounts of Zn and $ZnI_2$ than the test lamps of Tables V and VI; however, as pointed out above the dose densities of the $ZnI_2$ are comparable.

In addition, the Tables III, Table V and Table VI demonstrate that there is an upper threshold for the dose amount or dose density of $ZnI_2$ at which the lumens degrades. As shown in Table III, when the dose density of $ZnI_2$ is about 33.1 mg/cc the lamp efficacy drops to 49 lumens per watt. Similarly, with respect to Table V, in the Cell 4 test lamps the dose density of $ZnI_2$ is increased to about 30.0 mg/cc, which results in a decrease of lamp efficacy to about 61 lumens per watt.

In addition to the above-described tests, testing was performed in which the composition of the first metal halide was changed; however, the dose amount (2 mg) of the first metal halide remained the same. In addition, the dose amounts of $ZnI_2$ of Zn were maintained at about 0.4 mg and 0.1 mg respectively. The same size (4 mm arc gap) and watt (35 W), having a YAG arc tube as described above were used, including Xe as a buffer gas at 12 bar and room temperature. The below Table VII includes the test results.

TABLE VII

| Cell # | Metal Halide Dose Radiator Type (mg) | Metal Halide Dose Radiator Composition (wt %) | LPW (Lms/W) |
|---|---|---|---|
| 1 | NaI:TII:InI:CsI:CeI3 | 54:5:2:4:35 | 72 |
| 2 | NaI:TII:InI:CeI3 | 51:10:5:34 | 77 |
| 3 | NaI:TII:InI:CeI3 | 60:11:5:24 | 76 |
| 4 | NaI:TII:InI | 60:30:10 | 57 |
| 5 | NaI:TII:InI | 55:18:27 | 59 |

As shown, in the Cell 1 test lamp the first metal halide included Cesium iodide (CsI), which was removed in the Cell 2 and 3 test lamps. The lamp efficacy for Cell 2 and 3 test lamps, 77 and 76 lumens per watt respectively, is higher than the lumens output for the Cell 1 test lamps, which was 72 lumens per watt. In addition, in Cell 4 and 5 test lamps the $CeI_3$ was removed from composition of the first metal halide. As shown, with the removal of $CeI_3$, the lumens output for the Cell 4 and 5 test lamps dropped significantly relative to the lumens output of the Cell 1, 2 and 3 test lamps. Accordingly, the $CeI_3$ proved to be an effective radiator or light emitting compound for the first metal halide composition, which may also be effective without CsI.

The above tests demonstrate that zinc in the form of a combination of $ZnI_2$ and Zn in elemental form may serve as a substitute for mercury as a voltage riser. The dose amounts of the $ZnI_2$ in a 0.02 cc volume arc chamber may range from about 0.1 mg to about 0.8 mg, or include a density ranging from about 5 mg/cc to about 40 mg/cc in an arc chamber having a volume ranging from about 0.02 cc to about 0.30 cc. In addition, dose amounts of Zn ranging from 5 mg/cc to about 10 mg/cc may be used combination with $ZnI_2$. In an embodiment, the first metal halide (or light emitting component), may include from about 50% to about 60% by weight sodium iodide (NaI); about 18% to about 30% by weight Thallium iodide (TlI); and, about 10% to about 27% by weight of Indium iodide (InI). In addition, about 24% to about 34% by weight of Cerium iodide ($CeI_3$) may used in the light emitting element, in which case about 10% to about 11% by weight of TlI and about 5% by weight of InI is used.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What we claim as our invention is:

1. A mercury-free metal halide discharge lamp, comprising:

an arc tube having a sealed chamber;

a pair of electrodes positioned within the chamber, having electrodes tips spaced apart a determined distance from one another forming an arc region there between;

an inert gas sealed within the chamber under a pressure greater than about 100 Torr;

a metal halide mixture comprising more than one metal halide sealed within the chamber that produces a luminous flux;

zinc iodide at a concentration between about 1 and 100 mg/cc sealed within the chamber for producing a voltage output at the arc region; and, zinc at a concentration between about 3.6 and 72 mg/cc sealed within the chamber in elemental form and not derived from the metal halide mixture or zinc iodide.

2. The discharge lamp of claim 1 wherein the zinc iodide is present within the chamber in a dose amount of about 5 mg/cc to about 40 mg/cc.

3. The discharge lamp of claim 1 wherein the zinc iodide is present within the chamber in a dose amount of about 10 mg/cc to about 20 mg/cc.

4. The discharge lamp of claim 1 wherein the zinc is present within the chamber in a dose amount of about 5 mg/cc to about 10 mg/cc.

5. The discharge lamp of claim 1 wherein the zinc is present within the chamber in a dose amount of about 5 mg/cc.

6. The discharge lamp of claim 1 wherein in the zinc iodide is present within the chamber in a dose amount of about 20 mg/cc and the zinc is present within the chamber in a dose amount of about 5 mg/cc.

7. The discharge lamp of claim 1 wherein the metal halide mixture comprises metal halides selected from the group consisting of thallium iodide, cerium iodide, indium iodide and cesium iodide.

8. The discharge lamp of claim 1 wherein the dose amount of the metal halide mixture is about 100 mg/cc and is percent by weight about 50% to about 60% of sodium iodide, about 10% of thallium iodide, 5% indium iodide and 24% to about 34 of cerium iodide.

9. The discharge lamp of claim 8 wherein the zinc iodide is present within the chamber in a dose amount of about 20 mg/cc and the zinc is present within the chamber in a dose amount of about 5 mg/cc.

10. A mercury-free metal halide discharge lamp, comprising:

an arc tube having a sealed chamber;

a pair of electrodes positioned within the chamber and having electrodes tips spaced apart a determined distance from one another forming an arc region there between;

an inert gas sealed within the chamber at a pressure greater than about 100 Torr;

a metal halide mixture comprising more than one metal halide sealed within the chamber that produces a luminous flux;

zinc iodide at a concentration between about 1 and 100 mg/cc sealed within the chamber to generate a lamp operating voltage; and, zinc at a concentration between about 3.6 and 72 mg/cc sealed within the chamber that reacts with a portion of the halogen atoms or ions produced from the zinc iodide preventing the halogen atoms from reacting with the free electrons and with the metal of the metal halide mixture to generate the lamp luminous flux.

11. The discharge lamp of claim 10 wherein the zinc iodide is present within the chamber in a dose amount of about 5 mg/cc to about 40 mg/cc.

12. The discharge lamp of claim 10 wherein the zinc iodide is present within the chamber in a dose amount of about 10 mg/cc to about 20 mg/cc.

13. The discharge lamp of claim 10 wherein the zinc is present within the chamber in a dose amount of about 5 mg/cc to about 10 mg/cc.

14. The discharge lamp of claim 10 wherein the zinc is present within the chamber in a dose amount of about 5 mg/cc.

15. The discharge lamp of claim 10 wherein in the zinc iodide is present within the chamber in a dose amount of about 20 mg/cc and the zinc is present within the chamber in a dose amount of about 5 mg/cc.

16. The discharge lamp of claim 10 wherein the metal halide mixture comprises metal halides selected from the group consisting of sodium iodide, thallium iodide, cerium iodide, indium iodide, and cesium iodide and combinations thereof.

17. The discharge lamp of claim 10 wherein the dose amount of the metal halide mixture is about 100 mg/cc and is percent by weight about 50% to about 60% of sodium iodide, about 10% of thallium iodide, 5% indium iodide, 24% to about 34 of cerium iodide.

18. The discharge lamp of claim 17 wherein the zinc iodide is present within the chamber in a dose amount of about 20 mg/cc and the zinc is present within the chamber in a dose amount of about 5 mg/cc.

19. A mercury-free metal halide discharge lamp, comprising:

an arc tube having a sealed chamber;

a pair of electrodes positioned within the chamber, having electrodes tips spaced apart a determined distance from one another forming an arc region there between;

an inert gas sealed within the chamber under a pressure greater than about 100 Torr;

a metal halide mixture comprising more than one metal halide sealed within the chamber that produces a luminous flux; and, zinc iodide at a concentration between about 1 and 100 mg/cc sealed within the chamber to generate a lamp operating voltage; and a metal at a concentration between about 3.6 and 72 mg/cc selected from the group consisting of aluminum, gallium, indium and zinc.

20. The discharge lamp of claim 19 further comprising zinc sealed within the chamber in elemental form and not derived from the metal halide mixture or the zinc iodide and reacts with a portion of the halogen atoms or ions produced from the zinc iodide preventing the halogen atoms from reacting with the free electrons and with the metals of the metal halide mixture to generate the lamp luminous flux.

21. The discharge lamp of claim 19 wherein the lamp is used as an automotive headlamp, and the lamp body and legs are comprised of yttrium aluminum garnet.

22. The discharge lamp of claim 21 wherein the lamp includes an arc chamber having an internal volume ranging from about 0.01 cc to about 0.03 cc.

23. The discharge lamp of claim 22 wherein the zinc iodide is present within the chamber in a dose amount of about 20 mg/cc, the zinc is present in a dose amount of about 5 mg/cc and the metal halide mixture is present in a dose amount of about 100 mg/cc.

* * * * *